United States Patent [19]

Hellouin de Cenival et al.

[11] 4,226,280

[45] Oct. 7, 1980

[54] LINER FOR A PERFORATE PLATE OF A HEADER TANK OF A HEAT EXCHANGER HAVING TUBES

[75] Inventors: Bruno Hellouin de Cenival, Noisy-le-Roi; Jean-Louis Mouleñe, Elancourt, both of France

[73] Assignee: Societe Anonyme Francaise du Ferodo, France

[21] Appl. No.: 10,836

[22] Filed: Feb. 9, 1979

[30] Foreign Application Priority Data

Feb. 21, 1978 [FR] France ..... 78 04942

[51] Int. Cl.[3] ..... F28F 9/04

[52] U.S. Cl. ..... 165/69; 29/157.4; 29/523; 165/173; 285/137 R; 285/162; 285/192; 285/222

[58] Field of Search ..... 29/157.4, 523; 165/173, 165/175, 69, 178; 285/137 R, 162, 192, 196, 338, 382.4, 222

[56] References Cited

U.S. PATENT DOCUMENTS

| | | | |
|---|---|---|---|
| 3,583,478 | 6/1971 | Fieni | 165/69 |
| 3,654,965 | 4/1972 | Gramain | 285/137 R |
| 3,844,588 | 10/1974 | Jocsak | 285/162 |
| 3,948,315 | 4/1976 | Powell | 285/137 R |

FOREIGN PATENT DOCUMENTS

| | | | |
|---|---|---|---|
| 1429566 | 3/1976 | United Kingdom | 285/222 |

*Primary Examiner*—Sheldon Richter
*Attorney, Agent, or Firm*—Staas & Halsey

[57] ABSTRACT

A flexible liner, e.g. of rubber, for a manifold or apertured plate having collared apertures is disclosed, the manifold or apertured plate being part of a header tank of a heat exchanger having a bank of tubes, such as an automobile radiator. The liner has holes rimmed with sleeves corresponding to the collared apertures of the manifold or apertured plate. The sleeves are squeezed between their associated tubes and collar to effect fluid-tightness around the tubes. To prevent stress developed in the sleeves being transmitted to the rest of the liner, a zone of reduced section surrounds each hole and preferably is of similar contour and coaxial therewith. The zones of reduced section are preferably grooves opening onto the side of the liner remote from the side from which the sleeves project.

4 Claims, 5 Drawing Figures

LINER FOR A PERFORATE PLATE OF A HEADER TANK OF A HEAT EXCHANGER HAVING TUBES

The invention relates to heat exchangers comprising a bank of tubes depending from a header tank, the assembly of the tubes with the header tank being effected by the intermediary of a perforate plate or manifold.

In order to provide fluid tightness of the passage of the tubes through the apertured plate or manifold, it has been proposed to dispose on the side of the perforate plate facing the cover of the header tank a liner constituted by a flexible sheet of rubber or the like pierced with holes in correspondence with holes of the perforate plate and to provide rims both for the holes of the perforate plate and for the holes of the sheet, the rims or sleeves of the holes of the sheet being inside the rims or collar of the holes of the plate, so that after introducing the ends of the tubes into the passages of the holes left free, a radical expansion of the said ends ensures the squeezing of the sleeves of the rubber sheet against the tubes by bearing against the collars of the perforate plate, and thereby the fluidtightness of the passage of the tubes.

In certain heat exchangers it is necessary to divide, with one or more partitions, the space defined by the header tank into two or greater number of compartments and it has been proposed to provide the fluidtightness of the compartments with respect to one another, to make the partition or partitions defining the compartments depend from the cover and make the edge or edges of the said partition or partitions opposite the cover cooperate, under pressure with the rubber sheet, which sheet thus has a double fuction, in addition to which is sometimes the supplementary function of contributing to the fluidtightness of the assembly of the perforate plate and the cover.

In heat exchangers which are part of heating and/or ventilating and/or air-conditioning systems of automotive vehicles, the question of size and weight have a decisive importance. On the other hand, the perforate plate is in fact a relative thin metal sheet and the rubber sheet is little thick, whereas the tubes are arranged very close to one another with a view to obtaining a greater heat exchange surface for a predetermined exchanger size.

As the provision of fluidtightness of the passages of the tubes subjects the sleeves of the rubber shett to relatively elevated stresses, the parts of the sheet other than the sleeves may be affected thereby, notably in their positioning with respect to the perforate plate. The fluidtightness between the compartments of a header tank separated by a partition may be diminished thereby.

It is precisely an object of the invention to propose a sheet of rubber or the like which, although permitting mounting tubes of a heat exchanger in very close array in a manifold, perfectly functions in cooperation with the edge of a partition which is perpendicular thereto, to provide good fluidtightness between the compartment of the header tank on the one hand and the said partition on the other.

According to the invention, there is provided a local thinning of the sheet of rubber or the like in zone surrounding the sleeves present in the sheet for effecting fluidtightness of the passage of the tubes through perforate plate.

Such a thinning is advantageously formed by a groove present in the side of the sheet facing the cover of the header tank, or the interior side, the said thinning being parallel to the orifice of the sleeves.

According to an embodiment, the sheet of rubber or the like has in its unstressed condition an interior side of generally planar configuration.

The description which follows, given by way of example, refers to the accompanying drawings, in which.

Figure 1:
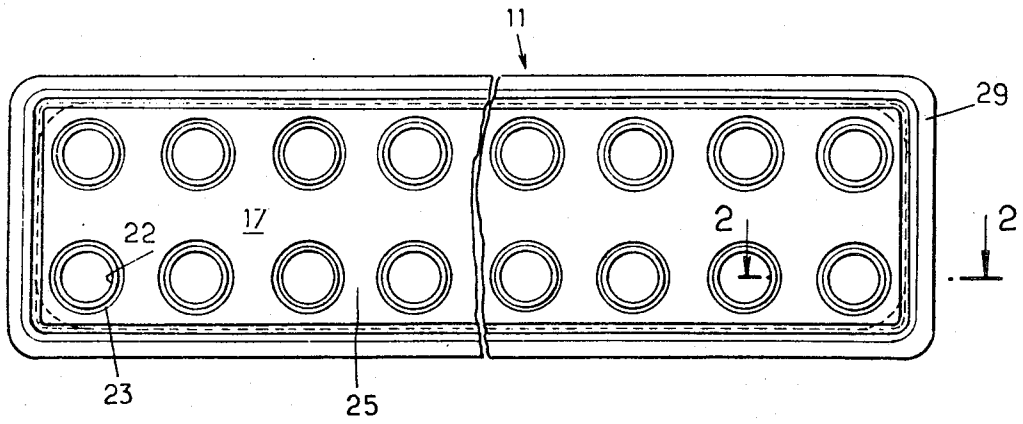
FIG. 1 is a view of a liner sheet of a perforate plate from its interior side.
Figure 2:
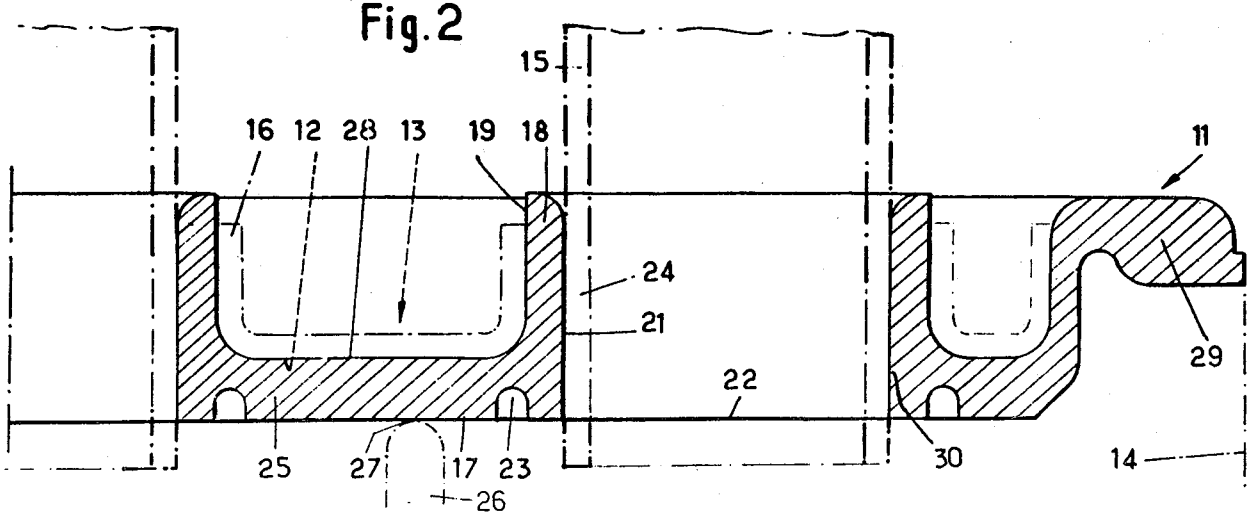
FIG. 2 is a sectional view taken on line 2—2 in FIG. 1, but on an enlarged scale.

The sheet 11, of rubber or the like, is intended to line the interior side 12 of a perforate metal plate or sheet 13 acting as a manifold of a header tank 14 of a heat exchanger comprising tubes 15, with parallel axes, interposed between the header tank 14 and an opposed tank. The holes of the manifold 13 are rimmed with collars 16 produced by stamping.

The sheet 11 has an interior side 17 of generally planar configuration, and sleeves 18, depending from its exterior side, disposed according to an arrangement similar to that of the collars 16. The said sleeves have a cylindrical outer surface 19 adapted to permit the engagement of the sleeves 18 inside the collars 16 without difficulty. The inner surfaces 21 of the sleeves are also cylindrical.

The invention provides that around the orifice 22 of each sleeve 18 the rubber sheet has, in the zone 30 of attachment of the sleeve, on the interior side 17, a groove parallel to the contour of the said orifice 22.

Figure 3:
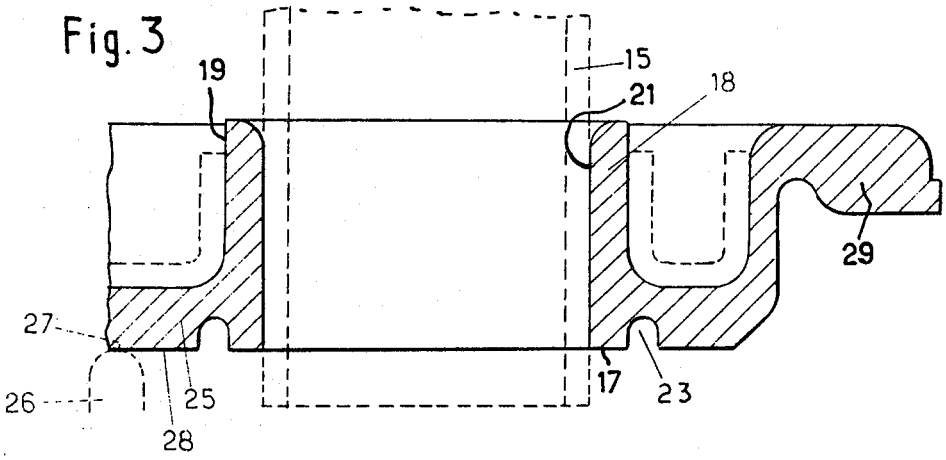
FIGS. 3 to 5 show different stages in the assembly of the tubes to a manifold provided with a liner sheet of FIGS. 1 and 2.

Upon the assembly of the tubes 15 with the manifold 14 the tubes are, first of all, inserted into the passages left free by the sleeves 18 (FIG. 3).

The parts 24 of the tubes 15 facing collars 16 of the manifold are then applied under pressure against the sleeves 18, so that the latter are compressed between the parts 24 and the collars 16 (FIG. 4) acting as back-ups. The flow of the rubbery material that is produced is without any detrimental effect on the behaviour of the parts 25 of the rubber sheet 11 included between the sleeves 18 and the latter, by reason of the grooves 23 that surround each of the openings of the tubes 15 and which become smaller in width, as shown at 23'.

The said grooves have a similar function when the ends of the tubes are then, optionally, subjected to a supplementary expansion in the part protruding relative to the interior side 12 of the manifold, i.e., exactly facing the said grooves (FIG. 5), forming a flare 31.

Thus any unloosening of the rubber sheet 11 with respect to the manifold 13 is avoided, even in case the sheet is merely positioned on the manifold.

Figure 4:
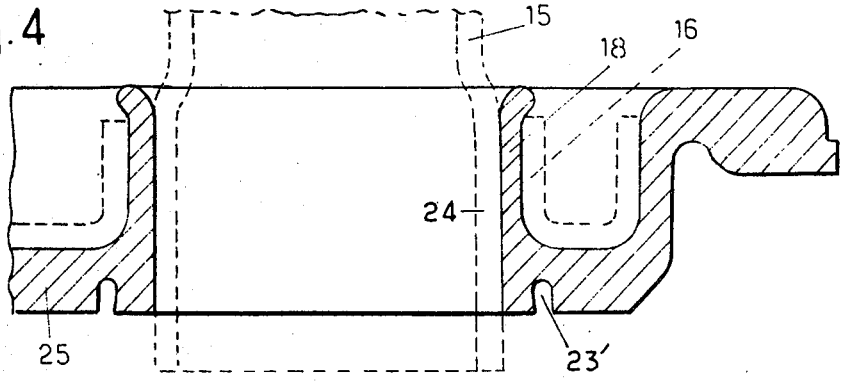
Figure 5:
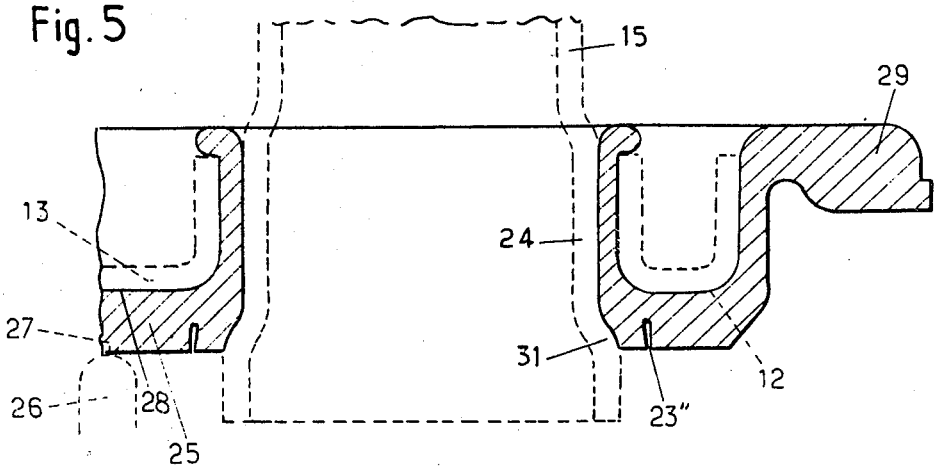

In the embodiment shown in FIGS. 3 to 5, the configuration of the groove 23 was chosen so that, after the first expansion, a groove of lesser transverse section remains, as shown at 23', which is still adapted to adsorb the material which flows in the course of the second expansion, as shown at 23'' in FIG. 5.

The parts 25 of the rubber sheet included between the sleeves may then effectively function to ensure fluidtightness between two neighboring compartments of the header tank 14 defined by the common partition as shown at 26, the application of the edge 27 of the said partition against the rubber sheet having a continuous back-up by the uninterrupted contact of the exterior side 28 of the sheet against the interior side of the manifold.

The rubber sheet 11 has a peripheral rim 28 adapted to ensure fluidtightness of the assembly between the manifold lined with the said sheet and the cover 14 of the header tank.

The invention provides that the rubber sheet has on its interior side 17 beads adapted to cooperate with a partition 26 to contribute to the fluidtightness of the separation of the compartments defined by the said partition.

The sheet according to the invention also has an advantageous application in the case that the assembly of the tubes with the perforate plate is effected by force-fitting.

The invention is also applicable when the liner is a thick plate devoid of sleeves or rims.

What is claimed is:

1. A flexible rubber or rubberlike liner for an apertured plate having collared apertures for a header tank, said liner having holes rimmed with sleeves corresponding to the collared apertures, said sleeves being adapted to be inserted into the collared apertures of the apertured plate for holding a plurality of tubes associated with the header tank, said sleeves, when mounted, being squeezed between the tubes and the collars to effect fluid tightness around the tubes, said liner being designed to effect fluid tightness at the periphery of the header tank and/or between compartments of said header tank, the improvement comprising a zone of reduced thickness surrounding each said sleeve whereby a deformation of portions of said liner beyond the zones of reduced thickness is prevented when stress is developed in said sleeves.

2. In a heat exchanger including a header tank, a bank of tubes associated with the header tank, the header tank having an apertured plate with collared apertures, comprising a liner of rubber or rubberlike material for the apertured plate having holes rimmed with sleeves adapted to be inserted into the collared apertures of the apertured plate for holding the tubes, said sleeves being adapted to be squeezed between the tubes and the collars to effect fluid tightness around the tubes, said liner being designed to effect fluid tightness at the periphery of the header tank and/or between compartments of said header tank and comprising the improvement of zones of reduced thickness surrounding said sleeves whereby a deformation of portions of said liner beyond the zones of reduced thickness is prevented when stress is developed in said sleeves.

3. The liner in accordance with claim 1, wherein said zones of reduced thickness comprise grooves opening on to the side of said liner remote the side from which said sleeves protrude.

4. The liner in accordance with claim 3, wherein said grooves are of similar countour as the holes through their associated sleeves and coaxial thereto.

* * * * *